US008196904B2

(12) United States Patent
Boehm

(10) Patent No.: US 8,196,904 B2
(45) Date of Patent: Jun. 12, 2012

(54) DEVICE FOR DISCHARGING LIQUID FROM A TANK AND METHOD FOR EMPTYING THE RESIDUE FROM A LINE SECTION

(75) Inventor: Alfred Boehm, Viechtach (DE)

(73) Assignee: Bartec Benke GmbH, Reinbek/Hamburg (DE)

( * ) Notice: Subject to any disclaimer, the term of this patent is extended or adjusted under 35 U.S.C. 154(b) by 463 days.

(21) Appl. No.: 12/585,450

(22) Filed: Sep. 15, 2009

(65) Prior Publication Data

US 2010/0078835 A1 Apr. 1, 2010

(30) Foreign Application Priority Data

Sep. 15, 2008 (DE) ..... 10 2008 047 122

(51) Int. Cl.
*B01F 3/04* (2006.01)

(52) U.S. Cl. ..... 261/76; 137/209

(58) Field of Classification Search ..... 261/76; 137/209
See application file for complete search history.

(56) References Cited

U.S. PATENT DOCUMENTS

| | | | | |
|---|---|---|---|---|
| 4,467,826 | A | | 8/1984 | Lorentz |
| 5,096,598 | A | * | 3/1992 | Pecen et al. ..... 210/741 |
| 5,922,969 | A | | 7/1999 | Haar |

FOREIGN PATENT DOCUMENTS

| | | | |
|---|---|---|---|
| CA | 2678471 | A1 | 9/2008 |
| DE | 1235760 | A | 3/1967 |
| DE | 3007688 | A1 | 9/1981 |
| DE | 19540884 | A1 | 5/1997 |
| DE | 29801625 | U1 | 6/1998 |
| DE | 19733715 | C1 | 9/1998 |
| DE | 19821559 | A1 | 11/1999 |
| DE | 20021937 | U1 | 5/2002 |
| DE | 20 2007012542 | U1 | 11/2007 |
| GB | 2321895 | A | 8/1998 |
| WO | WO 2007/087849 | A1 | 8/2007 |
| WO | WO/2008/106989 | A1 | 9/2008 |

* cited by examiner

*Primary Examiner* — Robert A Hopkins
(74) *Attorney, Agent, or Firm* — Jacobson Holman PLLC

(57) ABSTRACT

The invention relates to a device for discharging liquid from a tank, having a line section which is formed on a tank-side end region for a fluid connection with the tank and which line section comprises a discharge opening on a discharge-side end region lying opposite the tank-side end region, a feed unit for gas which is provided on the line section and via which gas can be introduced into the line section, a line shut-off valve for shutting off the line section and which is provided on the line section between the tank-side end region and the discharge-side end region, and a residue removal line which branches off at a branch-off from the line section and runs at a run-in back into the line section, whereby the branch-off is arranged between the tank-side end region and the line shut-off valve on the line section, and whereby the run-in is arranged between the line shut-off valve and the discharge-side end region. It is provided according to the invention that the feed unit for gas is designed to feed pressure gas into the line section. The invention further relates to a method for emptying the residue of a line section which can be carried out with the device according to the invention.

18 Claims, 2 Drawing Sheets

1
2
3
4
6
7
9
10
11
12
13
14
15
16
17
18
19
20
21
22
23
24
25
27
30
30'
31
31'
32
32'
36
36'
37
37'
40
41
42
50
51
52
53
54
60
61
62
63
65
66
67
67'
68
70
71
72
73
90
91
99

DEVICE FOR DISCHARGING LIQUID FROM A TANK AND METHOD FOR EMPTYING THE RESIDUE FROM A LINE SECTION

This application claims the priority of German no. 10 2008 047 122.4 filed Sep. 15, 2008, hereby incorporated by reference.

The invention relates to a device for discharging liquid from a tank according to the preamble of claim 1. Such a device has the following features: a line section which is formed on a tank-side end region for a fluid connection with the tank and which comprises at least one discharge opening on a discharge-side end region lying opposite the tank-side end region, a feed unit for gas which is provided on the line section and via which gas can be introduced into the line section, a line shut-off valve for shutting off the line section and which is provided on the line section between the tank-side end region and the discharge-side end region and a residue removal line which branches off from the line section at a branch-off and runs back into the line section at a run-in, whereby the branch-off is arranged between the tank-side end region and the line shut-off valve on the line section, and whereby the run-in is arranged between the line shut-off valve and the discharge-side end region on the line section.

The invention further relates to a method for emptying the residue from a line section according to the preamble of claim 12. A generic method serves for emptying the residue from a line section which is formed on a tank-side end region for a fluid connection with a tank, which comprises at least one discharge opening on a discharge-side end region lying opposite the tank-side end region and which comprises a line shut-off valve for shutting off the line section, which line shut-off valve is provided between the tank-side end region and the discharge-side end region on the line section.

For example in the delivery of fuels such as high quality heating oils or diesel fuels with biosynthetic additives, increasingly close attention must be paid to avoid products mixing. This makes it necessary to thoroughly empty the line system when the product is changed in order to ensure that the preceding product is removed as extensively as possible before the next product is conveyed in the same line system. This can be difficult particularly in installations with air separators, so-called gas measurement inhibitors, as such air separators frequently have dead areas which are difficult to empty after the product change.

For emptying in the context of a product change, the so-called "residue removal", two solutions are known. According to DE 1 235 760 A and DE 200 21 937 U1, the remaining product is pumped back into the discharge tank, whereby according to DE 200 21 937 U1 the volume contained in a hose can also be conveyed back into the tank. In order to compensate for the liquid volumes discharged during the residue removal, the line system is vented on the collecting line according to DE 200 21 937 U1.

According to the generic WO 2007/087849 A1 the remaining product is on the other hand discharged to the customer, whereby the discharged amount can be measured via a separate measuring unit.

The generic WO 2007/087849 A1 describes a device for discharging a liquid from a tank with a conveying line which is connected at one of its end regions via a bottom valve to the tank and which comprises a gas separator in the line system. Means are thereby provided for removing and discharging residual liquid which is present, after shutting off the tank shut-off unit, on the side of the tank shut-off unit facing away from the tank in the conveying line, as well as means for measuring the amount of the residual liquid discharged. The means for removing and discharging residual fluid comprise a residue removal line which branches off from the conveying line at the gas separator and runs back into the conveying line at a location further away from the tank. The residue removal line allows reliable emptying of the conveying line including the gas separator when the product is changed, so that mixing because of residual liquid amounts in dead areas of the gas separator can be extensively prevented. In order to compensate for the liquid volumes discharged during the residue removal, according to WO 2007/087849 A1 the bottom valve of the tank is vented via a vent valve during residue removal.

It is known from DE 198 21 559 A1 that the liquid volume contained in the discharge hose of a dispensing pump is emptied by means of air after the end of the discharge, which air is introduced into the free end of the discharge hose, so that the liquid contained in the hose returns to the dispensing pump.

PCT/EP2007/001833 relates to a device for detecting the amount during the discharge of a liquid having a gas portion. The device comprises a discharge line system which initially ascends following a pump and then descends again. In the descending region a fill degree measuring unit and a flow measuring unit are provided for determining the discharge volume. As in this case the fill degree and thus the gas portion are determined in the measurement, a gas separator can be omitted, whereby this can simplify the emptying of the installation when the product is changed.

Further installations for the measured liquid discharge are known from DE 195 40 884 A1, DE 30 07 688 A1, DE 197 33 715 C1 and DE 20 2007 012 542 U1.

It is an object of the invention to develop a generic device and a generic method so that a particularly through and reliable emptying of the line section can be achieved with limited use of equipment even with more complex progressions of the line system.

This object is achieved according to the invention by a device having the features of claim 1 and by a method having the features of claim 12. Preferred embodiments are indicated in the respective dependent claims.

A device according to the invention for discharging liquid from a tank is characterised in that the feed unit for gas is formed to supply pressure gas into the line section.

A first basic idea of the invention can be seen in that pressure gas is supplied into the line section for the purpose of emptying the line section, whereby pressure gas can be understood to be a gas which is at a higher pressure in comparison with ambient atmospheric pressure. Unlike mere venting, wherein the atmospheric gas flowing in merely fills up the volume becoming free and does not carry out any independent conveying effect, a pressure gas can independently displace and set in motion the liquid volume to be discharged. In particular it is possible by means of the pressure gas for the liquid to be removed to also be transported through complex line systems and for example be carried up an inclined section. The pressure gas can be in particular compressed air. The pressure gas is usefully at a pressure which is at least 10% above the ambient atmospheric pressure. For example the pressure can be 0.1 bar to 10 bar, in particular 1 bar to 8 bar, preferably 2 bar to 3 bar above the ambient atmospheric pressure.

A further basic feature of the invention is that the pressure gas is to act from above upon the liquid to be displaced. An undesirable foaming of the liquid can hereby be counteracted. This is since through gas action from above, it is possible to prevent that compressed air bubbles through the product upon displacement of the product, what could in turn lead to formation of foam, particularly if the displaced product is heating oil. It is thus advantageous that the pressure gas pushes down on the liquid to be displaced in the entire line section from above.

In order to achieve an effect of the pressure gas from above, it is useful that the gas is introduced into the line section by means of the feed unit at the highest point of the line section. Having regard to the device according to the invention, a preferred embodiment thus consists in that the feed unit for gas is arranged so that the gas is introduced into the line section by means of the feed unit at the highest point of the line section.

The highest point at which the pressure gas is supplied can thereby be provided on the (tank-) end side on the line section. The highest point can, however, also be arranged in a middle region along the line section. It may be preferable in particular for the gas to be introduced into the line section by means of the feed unit in an upper apex region of the line section, whereby the highest point of the line section is preferably arranged in this apex region.

Insofar as the line section comprises at least one lower apex region, a compensating line can be provided above this lower apex region, which compensating line is released during the residue removal. This compensating line branches off from the line section on one side of the lower apex region and runs back into the line section on the other side of the lower apex region and thus forms a bypass of the lower apex region. If such a compensating line is present on both sides of the lower apex region, vessels communicating via this line can be formed without gas having to be conducted for this purpose around the lower apex region. The gas can thus act, in order to avoid foam formation, on both sides of the lower apex region from above upon the liquid to be displaced. In order to prevent foam formation particularly reliably, the compensation line can run at the highest point of the tank-side end region into the line section, in particular on a tank valve and/or on the collecting line.

The compensating line can be switchable according to the invention so that it can be released merely during the residue removal. In order to provide switchability, a valve is usefully provided on the compensating line.

A particularly preferred embodiment is thus formed in that a switchable compensating line leads to the tank-side end region, preferably to the highest point of the tank-side end region, and indeed preferably from a region of the line section lying in the region of the feed unit for gas.

Furthermore, it is advantageous for acting on the liquid from above that the gas is introduced by means of the feed unit on the upper side of the line into the line section. The upper side of the line is understood to mean a region which is on the upper side in a cross-sectional view of the line section, thus in particular the pipe upper side.

Said measures for action on liquid from above, in particular the feeding of pressure gas always at the highest point of the pipeline system, and also the compensating line which branches off from the line system and runs into the line system above the lower apex region can be regarded as independent aspects of the invention which can be implemented independently of the remaining invention features but also in combination with one or more of the remaining invention features.

A further preferred embodiment of the invention lies in that the feed unit for gas lies in the flow direction prior to the line shut-off valve. According to this embodiment the pressure gas is fed into the line section in a region which lies between the tank and the line shut-off valve. The flow direction can thereby be understood to mean in particular the flow direction during the discharge, thus the direction of a flow directed from the tank-side end region to the discharge-side end region. This arrangement of the pressure gas supply allows a two-stage residue removal from the line, as described below.

It is thus possible in a first residue removal phase by means of the gas for liquid to be displaced which is present in the line section between the tank-side end region and the line shut-off valve, thus being present in the flow direction prior to the line shut-off valve in the line section, whereby the line shut-off valve is closed at least in the said residue removal phase. The liquid displaced in the first residue removal phase is usefully removed via a residue removal line from the line section, and fed on the side of the line shut-off valve facing away from the tank back into the line section, so that the liquid does not flow back into the tank and can instead be discharged. Insofar as the region of the line section which lies in the flow direction prior to the line shut-off valve and which is emptied during the first residue removal phase has a local height minimum in the line system, thus a lower apex region, a compensating line which bypasses this height minimum can ensure that the gas acts upon the liquid from above on both sides of the height minimum. The gas does not therefore have to flow around the height minimum, thereby reducing foam formation. A shut-off valve arranged in the compensating line is thus opened, in particular in the first residue removal phase.

In the first residue removal phase it can also be provided that at least a part of the displaced liquid, namely in particular the fluid present between the branch-off of the residue removal line and the line shut-off valve flows in the line section against the flow direction of the discharge before it gets into the residue removal line at the branch-off and is discharged.

In the subsequent, second residue removal phase the line shut-off valve can be opened and liquid present between the line shut-off valve and the discharge-side end region is displaced towards the discharge-side end region, thus in the direction of the flow direction of the discharge. A multi-stage residue removal, for example also with at least partially opposing flow directions of the residual liquid, can thus be provided. Insofar as a residue removal line is provided which bypasses the line shut-off valve, the line shut-off valve can also remain closed in the second residue removal phase, whereby the pressure gas then reaches the side of the line shut-off valve facing away from the tank via the residue removal line.

It is preferred according to the invention that the feed unit for gas lies in the flow direction prior to the line shut-off valve. It can for example be provided according to the invention that the gas is introduced on the (tank-) end side on the line section into the line section. In particular the gas can be supplied in the tank-side end region. It is accordingly advantageous that the feed unit for gas is arranged in the tank-side end region and/or, as seen in the flow direction, prior to the branch-off of the residue removal line, what facilitates for example a particularly simple construction.

It can alternatively be provided that the feed unit for gas is arranged between the branch-off of the residue removal line and the line shut-off valve on the line section. Accordingly a further option of the invention lies in that the feed unit feeds the gas into the line section in a region which lies along the line section between the branch-off of the residue removal line and the line shut-off valve. According to this embodiment the feed of the residue removal gas takes place therefore not on the end side on the line section but instead in a middle region of the line section, to which the residue removal line forms a bypass. This can be advantageous in particular with complex line systems.

In order that the displaced liquid constantly leaves at the same location during both residue removal phases, the fluid displaced during the first residue removal phase can be fed back into the line section via the residue removal line on the side of the line shut-off valve facing away from the tank. The multi-stage residue removal which is possible by means of the arrangement of the feed device for gas according to the invention can be carried out in a particularly simple way by means of the pressure gas provided according to the invention, as both residue removal phases can be carried out by means of this pressure gas without it being necessary for example to change the running direction of a pump.

The line section according to the invention can be formed for example as a pipeline section. For the fluid connection with the tank, the tank-side end region can for example comprise a connection flange. At least one tank shut-off valve is usefully provided between the tank and the line section, whereby within the residue removal that liquid can then be removed which is present on the side of the tank shut-off valve facing away from the tank after closure of the tank shut-off valve.

The device for discharging liquid from a tank is usefully provided for pump operation. For this case a pump can be present which is preferably arranged in the tank-side end region. However, a pure gravity operation can also be provided, in which no pump is necessary.

A discharge valve can be provided for example at the discharge opening, to which discharge valve a discharge hose can preferably connect. The discharge hose can for example be a wet hose or a dry hose. However, a further line section can also be connected to the discharge opening, whereby the two line sections can connect to each other at the discharge opening also with equal cross-section. According to the invention a plurality of discharge openings can also be provided.

The feed unit for gas usefully comprises at least one feed line which runs for example between the branch-off of the residue removal line and the line shut-off valve or in the flow direction prior to the branch-off of the residue removal line into the line section and which is in a line connection with a pressure generating unit. A valve is usefully provided on the feed line.

The line shut-off valve can preferably be remotely actuated and appropriately comprises at least two switch positions, namely open line cross-section and closed line cross-section.

The residue removal line according to the invention, which is in a line connection with the line section at the branch-off and at the run-in, forms a bypass of a part of the length of the line section. In particular the residue removal line bypasses the line shut-off valve and depending upon the arrangement of the gas feed unit also bypasses said gas feed unit, but this is not compulsory. The residue removal line allows residual liquid present between the tank and the line shut-off valve to be conveyed to the discharge-side end region in the first residue removal phase when the line shut-off valve is closed.

The residue removal line is usefully formed with a smaller inner cross-section in comparison with the line section, whereby the inner cross-section can in particular be smaller by at least factor 2. On the one hand disruptive outflows can hereby be prevented during the main discharge and on the other hand it is possible to prevent significant product volumes from remaining in the residue removal line, which could lead to undesirable product mixing.

Insofar as direction indications and location indications are used in association with the invention, these can relate in particular to the line progression of the line section. In the optionally provided arrangement of the feed unit between the branch-off and the line shut-off valve therefore, for example, the feed unit is located between the branch-off and the valve, as observed along the line section.

It is particularly advantageous that a residue removal shut-off valve is provided on the residue removal line. By means of this residue removal shut-off valve the residue removal line can be shut off in the second residue removal phase but also during the main discharge, so that undesirable product flows can be suppressed. During the first residue removal phase, the residue removal shut-off valve is appropriately open. The residue removal shut-off valve is usefully formed so that it can be remotely actuated and comprises at least one open and one completely closed position.

The residue removal shut-off valve which is arranged on the residue removal line is preferably provided in the region of the run-in of the residue removal line. It is hereby possible to prevent a significant liquid residue volume from remaining in the residue removal line. The arrangement in the region of the run-in can in particular be understood in that the distance along the residue removal line of the residue removal shut-off valve from the line section is smaller than the diameter of the line section in the region of the run-in.

A further preferred embodiment of the invention consists in that the feed unit for gas is arranged in the tank-side end region or the feed unit for gas is arranged in the region of the line shut-off valve on the line section. It is further particularly advantageous that the run-in of the residue removal line is arranged in the region of the line shut-off valve on the line section. Through the arrangement of the feed unit and/or the run-in directly on the line shut-off valve it is possible to prevent dead spaces forming in the region of the line shut-off valve, in which liquid could remain during the individual residue removal phases under certain conditions. The arrangement of the feed unit and/or the residue removal line in the region of the line shut-off valve can be understood in particular in that no further valves and/or cross-sectional enlargements of the line section are provided between the feed unit or run-in, respectively, and the line shut-off valve.

According to a further advantageous embodiment of the invention the line section comprises an upper apex region. According to this embodiment the line section has a varying height, whereby an at least local height maximum is given in the upper apex region. In such an upper apex region, gas portions present during the initial filling of the line section can collect automatically, so that a specific purging of the line section during the filling is possible.

The line shut-off valve and/or the feed unit for gas is/are usefully arranged in the upper apex region of the line section. Such an arrangement can lead to a liquid flow which is downwardly orientated from above taking place during one or both residue removal phases. As a flow orientated downwardly from above is supported by gravity, this embodiment can result in a particularly effective emptying of the line section.

It is further advantageous that the run-in of the residue removal line is arranged in the upper apex region of the line section, whereby a particularly compact structure and a reliable residue removal can be obtained.

A further preferred embodiment of the invention consists in that a purge unit for purging the line section is arranged in the upper apex region of the line section. The purge unit can for example comprise a purge line, on which a purge valve is arranged, which can be opened for purging. In particular the purge line can be guided into the tank or into an intermediate container. The intermediate container can be periodically emptied, for example once daily. By arranging a purge unit in the upper apex region, gas pockets collecting automatically in the upper apex region during filling for example can be reliably removed.

It is further advantageous that the branch-off of the residue removal line is arranged in a lower apex region of the line section. This measure can also work against the formation of undesirable dead areas. Insofar as a pump is provided in the line section it is particularly advantageous that the branch-off of the residue removal line is arranged on the pump, as such a pump is particularly prone to dead volumes due to the comparatively complex geometry. Accordingly the pump is advantageously arranged in the lower apex region of the line section.

A further advantageous embodiment consists in that for the determination of a discharged liquid amount, in particular a discharged liquid volume, a flow measuring unit and a fill degree measuring unit are arranged on the line section. By means of the flow measuring unit, which can for example be formed as a measurement turbine, the fluid amount flowing per time unit in the line section can be determined. The fill degree measuring unit allows determination of the liquid portion in the flowing fluid, which can be reduced through gas pockets. By calculating the values of the flow measuring unit and the fill degree measuring unit, a liquid amount value can be obtained which is compensated in relation to possible gas impurities.

The flow measuring unit and the fill degree measuring unit are appropriately arranged in a region of the line section which is inclined in relation to the horizontal plane, which thus has a varying height. The two measuring units are usefully arranged between the purge unit and the discharge opening and/or between the line shut-off valve and the discharge opening on the line section.

Furthermore it is particularly advantageous that the flow measuring unit and the fill degree measuring unit are arranged between the run-in of the residue removal line and the discharge opening on the line section. This permits a measured residue removal during the first residue removal phase as the fluid situated upstream of the line shut-off valve, which is displaced in the first residue removal phase via the residue removal line, flows past the measuring units.

According to a possible development of the invention a purge unit for purging the line section is arranged on the line section on a side of the line shut-off valve facing away from the tank-side end region, in particular in the discharge-side end region. The purge unit can for example comprise a purge line which is arranged on the line section. At least one purge valve is usefully provided on the purge line. The purge line can for example run into a container. By means of this purge unit, air pockets can be removed which form in the discharge-side end region under certain conditions during the filling of the device in the case of an inclined position of the device and which cannot flow off, by reason of the inclined position, to the upper apex region. The purge unit can be arranged in particular at the end of the line section. The aforementioned purge unit can be provided alternatively, preferably or additionally to the previously mentioned purge unit in the upper apex region. The aforementioned purge unit can be regarded as an independent aspect of the invention.

It is further useful that an inclinometer is provided for determining the angular position of the line section. By means of the inclinometer, an inclined position of the line section can be established. It can be established in particular whether the inclined position is so great that the formation of end-side air pockets and/or the formation of position-related dead spaces is to be feared, from which remaining volumes of the liquid cannot flow away. In this case a control signal, e.g. for actuating the purge unit, and/or a warning signal can be emitted. The inclinometer is usefully connected to a horizontal part of a tanker vehicle and can detect an inclined position in order to be able to determine remaining amounts. The inclinometer can preferably be a 2-axis inclinometer.

The device according to the invention usefully serves for the discharge of liquid from a tank of a tanker vehicle. In particular the device can be arranged on a tanker vehicle.

The invention also relates to a tank arrangement with at least one tank and a device according to the invention for discharging liquid from a tank, whereby the line section of the device according to the invention is in fluid connection with the tank, in particular via a tank valve, for discharge of liquid on its tank-side end region. A plurality of tank valves can also be provided.

A method according to the invention is characterised in that pressure gas is introduced into the line section between the tank-side end region and the line shut-off valve, which pressure gas displaces liquid from the line section, whereby during a first residue removal phase when the line shut-off valve is closed, liquid present in the line section between the tank-side end region and the line shut-off valve is displaced by means of the pressure gas, and during a subsequent, second residue removal phase, in particular when the line shut-off valve is open, liquid present in the line section between the line shut-off valve and the discharge-side end region is displaced by means of the pressure gas.

In the second residue removal phase the line shut-off valve can be open. Insofar as a residue removal line is provided which bypasses the line shut-off valve, the line shut-off valve can also remain closed in the second residue removal phase, whereby the pressure gas, for the purpose of emptying the region between the line shut-off valve and the discharge opening, passes via the residue removal line into the region between the line shut-off valve and the discharge opening.

A core idea of the method according to the invention can be seen in a two-stage residue removal process, whereby in the first residue removal phase a line region upstream of the shut-off valve is emptied and in the second residue removal phase a line region downstream of the line shut-off valve is emptied. The terms "upstream" and "down-stream" are hereby intended to relate to the flow direction arising during the emptying of the tank, thus during the main discharge. The two-stage residue removal allows a particularly thorough emptying of the line section, in particular also with complex line geometries.

The method according to the invention can be carried out in particular by means of a device according to the invention and/or a tank arrangement according to the invention, whereby the advantages mentioned in this connection can be achieved. Aspects of the invention mentioned in association with the method according to the invention can also be used with the device according to the invention and with the tank arrangement according to the invention. At the same time invention aspects which are mentioned in association with the device according to the invention and the tank arrangement according to the invention can be used in the method according to the invention.

According to a preferred embodiment of the method, during the first residue removal phase, liquid present in the line section between the tank-side end region and the line shut-off valve is displaced at least partially in the direction towards the tank-side end region, and during the subsequent, second residue removal phase liquid present in the line section between the line shut-off valve and the discharge-side end region is displaced in the direction towards the discharge-side end region. The fluid displaced towards the tank-side end region is usefully removed from the line section via a residue removal line and conveyed back into the line section on the side of the line shut-off valve facing away from the tank, so that the fluid does not flow back into the tank, but can instead be discharged. The residue removal line usefully branches off from the line section in a middle region between the tank-side end region and the line shut-off valve, so that fluid flows to the residue removal line from two sides of the line section during the first residue removal phase.

According to this embodiment, in the individual residue removal phases partially different flow directions of the liquid are provided in the line section, which allows a particularly efficient residue removal, in particular in the case of complex line geometries.

It is particularly preferred according to the invention that a residue removal line is provided which branches off at a branch-off from the line section and runs back into the line section at a run-in, whereby the branch-off is arranged between the tank-side end region and the line shut-off valve on the line section and whereby the run-in is arranged between the line shut-off valve and the discharge-side end region on the line section, and that during the first residue removal phase liquid present in the line section between the tank-side end region and the line shut-off valve is removed from the line section via the residue removal line and conveyed back into the line section between the line shut-off valve and the discharge-side end region. According to this embodiment the liquid which is displaced during the first residue removal phase from the line region of the line section facing the tank is removed via the residue removal line and brought back again into the line section in the line region facing away from the tank. The liquid displaced during the two residue removal phases can thus be discharged via a single opening, in particular via the discharge opening.

It is particularly preferable that a residue removal shut-off valve is arranged on the residue removal line, which residue removal shut-off valve is opened in the first residue removal phase and preferably closed in the second residue removal phase. Through such an operation of the residue removal valve, undesirable liquid flows can be prevented via the residue removal line.

A pump can also be arranged on the residue removal line, in particular for a particularly rapid residue removal, with which pump fluid present in the residue removal line can be conveyed.

According to a further advantageous development of the method, a fill level is detected in the line section between the line shut-off valve and the discharge-side end region and/or in the residue removal line, and the first residue removal phase is ended when the detected fill level reaches a predetermined value. This can take place automatically for example via a control unit. In particular it can be established according to this embodiment whether during the first residue removal phase liquid is displaced by gas between the line shut-off valve and the discharge-side end region and/or in the residue removal line, whereby this is an indicator that the region between the tank-side end region and the line shut-off valve is completely emptied, so that the gas further flowing into this region initially reaches the residue removal line and then also reaches the region lying between the line shut-off valve and the discharge-side end region. The first residue removal phase can thus be ended in particular if the detected fill level reaches a predetermined lower value. The fill level can be measured continuously or in stages, whereby it can be sufficient to differentiate whether a remaining level is present at the measurement point or whether there is an empty status. In this respect, the fill level detection can also be carried out by means of an empty status sensor. In order to reduce the number of sensors, the level measurement can also be carried out in principle by means of the fill degree measuring unit, which is provided for measuring the amount discharged. The fill degree measuring unit is preferably based upon an electric field which is generated inside the fill degree measuring unit. It can work in particular capacitively. It is possible with a fill degree measuring unit according to the invention to continuously measure the fill level in the fill degree measuring unit. If the fill degree measuring unit is used for level measurement the measured fill degree is proportional to the fill level.

It is particularly advantageous that a discharge amount measurement is carried out in the line section, in particular between the line shut-off valve and the discharge-side end region, preferably between the run-in of the residue removal line and the discharge-side end region. In particular, the amount measurement can be carried out at least in the first residue removal phase, whereby this is particularly advantageous if the volume displaced during the residue removal phase is discharged from the system and transferred to a customer, meaning that for charging purposes knowledge of the discharge volume which should be as accurate as possible is necessary.

The amount measurement can be in particular a volume measurement. A fill degree measuring unit and a flow through measuring unit are usefully provided for the measurement, the results of which are calculated together in order to obtain liquid amount values, in which possible gas pockets are taken into consideration.

Furthermore it is useful that the discharge amount measurement is stopped at the beginning or in the course of the second residue removal phase and a previously determined amount is added to the measured discharge amount. This embodiment takes into consideration that in the course of the second residue removal phase the fill level in the line section can reach the region of the measurement installation for amount measurement, meaning that an amount measurement with this installation is henceforth no longer possible under certain conditions. A previously determined value is thus added to the measurement value obtained thus far whereby said previously determined value represents the liquid volume contained in the discharge-side end region, and can for example be determined previously by volumetric measurement of the content of the line section. The previously determined value can also be compensated in relation to gas portions which have previously been determined by means of the fill degree measuring unit.

It is further advantageous that following the second residue removal phase an over-pressure in the line section is removed by means of at least one purge unit, whereby a purge unit is arranged in particular in an upper apex region of the line section and/or in the discharge-side end region. This facilitates reliable re-filling.

It is also useful that the liquid which is displaced in the first and/or in the second residue removal phase from the line section, is conveyed back into the tank or discharged via the discharge opening.

The device according to the invention can be designed in particular as a heating oil measurement system, preferably with measured complete emptying. The liquid can thus be heating oil but also another fuel or for example also milk.

The invention is explained in greater detail below by reference to preferred embodiments which are shown schematically in the drawings, in which.

Elements having the same effect are characterised by the same reference numerals in the drawings.

Figures 1, 2:
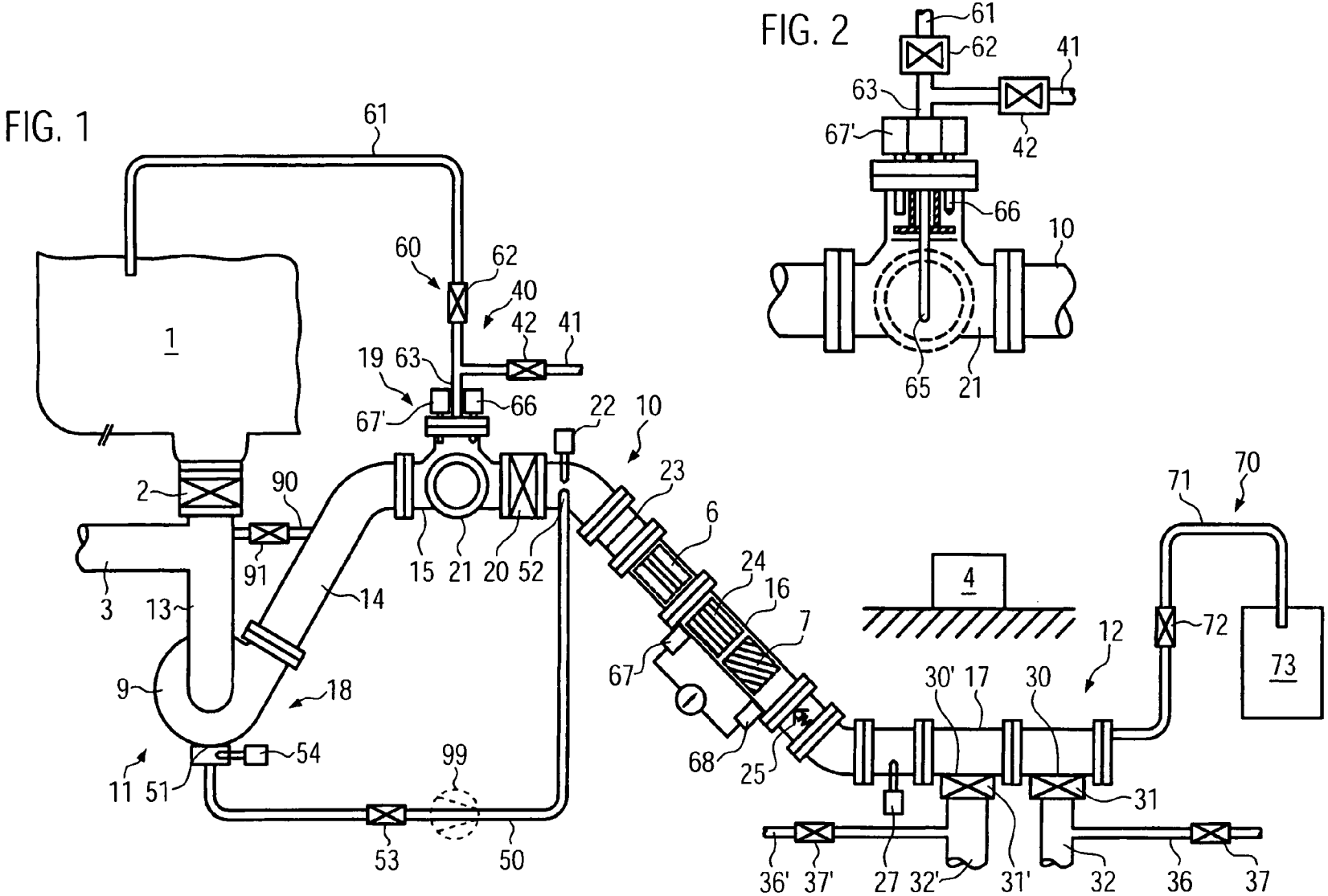
FIG. 1 shows a first embodiment of the device according to the invention.
FIG. 2 shows a detailed view of the distributor and sensor head of the device of FIG. 1.

A first embodiment of a device according to the invention for discharging liquid from a tank is shown in FIGS. 1 and 2. According to this embodiment a tank 1 is provided, on the bottom side of which a tank valve 2 designed as a bottom valve is arranged. The tank 1 is in a fluid connection with a collecting line 3 via the tank valve 2, which collecting line 3 is merely shown in sections in FIG. 1. Further tanks can be arranged on this collecting line 3 via further tank valves, whereby the tanks can be formed in particular as tank segments.

The device according to the invention comprises a line section 10 which is in a fluid connection on a tank-side end region 11 with the collecting line 3 and thus via the tank valve 2 with the tank 1. The line section 10 comprises two discharge openings 30, 30' on a discharge-side end region 12 lying opposite the tank-side end region 11.

The line section 10 comprises a series of respectively adjacent line regions 13, 14, 15, 16 and 17, which each have a different orientation in relation to a horizontal surface. The first line region 13, in which the tank-side end region 11 is formed and via which the line section 10 is in connection with the tank 1, decreases in its height with increasing distance from the tank 1 and the tank-side end region 11. It is shown extending vertically in the embodiment 13 shown.

A second line region 14 connects to the first line region 13, in which second line region 14 the line height increases with increasing distance from the tank-side end region 11. A third line region 15 connects to the second line region 14, which third line region 15 extends essentially horizontally. A fourth line region 16 connects in turn to this third line region 15, which fourth line region 16 extends in an inclined manner in relation to the horizontal and in which the line height decreases with increasing distance from the tank-side end region 11. In turn, a fifth line region 17 connects to this fourth line region 16, in which fifth line region 17 the line section 10 extends again at least approximately horizontally and in which the discharge-side end region 12 is formed.

A lower apex region 18 of the line section 10 is formed between the first line region 13 and the second line region 14. The third line region 15 forms an upper apex region 19 of the line section 10.

A pump 9 for conveying fluid from the tank 1 is provided in the lower apex region 18 on the line section 10. In the further progression of the line section 10, thus with increasing distance from the tank-side end region 11 and with decreasing distance from the discharge-side end region 12, a distributor 21 is provided in the line section 10. A line shut-off valve 20 connects to this distributor 21 in the further progression of the line section 10. A wetting sensor 22 in turn connects to the line shut-off valve 20 in the further line progression. The distributor 21, the line shut-off valve 20 and the wetting sensor 22 are arranged in the horizontal third line region 15.

In the further progression of the line section 10, thus with further increasing distance from the tank-side end region 11, a sieve 23 connects hereto, followed by a fill degree measuring unit 6, followed by a flow straightener 24, followed by a flow measuring unit 7, followed by a valve 25. The elements 23, 6, 24, 7 and 25 are thereby arranged in the inclined fourth line region 16.

The sieve 23 serves to keep larger particles away from a measurement section consisting of the fill degree measuring unit 6 and the flow measuring unit 7 and possibly the flow straightener 24. The fill degree measuring unit 6 works capacitively and comprises a capacitor plate stack arranged in the line cross-section which is used electrically to measure the fill degree and which can on the other hand also act as a flow straightener. The flow straightener 24 is formed as a tube bundle flow straightener. The flow measuring unit 7 is formed as a volume meter, in particular as an indirect volume meter, for example as a measurement turbine. The valve 25 is formed as a multi-functional valve which can regulate the flow-through for example in two stages. For example a discharge with full pump power (e.g. 800 l/min) can be provided in the first stage and in the second stage a power <200 l/min for the discharge into tanks without an overfill prevention mechanism. In addition the valve 25 can have an end position damping and pressure compensation as well as optionally a non-return valve.

By means of the capacitive fill degree measuring unit 6 according to the invention, the liquid content in the line cross-section can be determined independently of where gas pockets are located and whether a continuous boundary area between liquid and gas is given. In the case of optical sensors, this is possible only to a limited extent under certain circumstances.

A further wetting sensor 27 and the two discharge openings 30, 30' follow onto the valve 25 and onto the fourth line region 16 in the further progression of the line section 10 with increasing distance from the tank-side end region 11. The discharge openings 30, 30' are arranged in the horizontal fifth line region 17. The wetting sensor 27 is preferably also arranged in the horizontal fifth line region 17. A hose connection 32 or 32' for a wet hose or a dry hose is provided on the discharge openings 30 or 30' via a respective discharge valve 31 or 31'.

The fourth line region 16 with the measurement section and the second line region 14 are provided in an inclined manner, so that these line regions can independently degas during filling, whereby the gas collects in the intermediately lying third line region 15 in the region of the distributor 21.

In order to degas the system in the third line region 15 during filling, a purge unit 60 is provided. The purge unit 60 comprises a purge line 61 which is connected via a common line element 63 to the distributor 21 on the line section 10. On its end facing away from the line section 10, the purge line 61 leads into the tank 1 or into an intermediate container which is not shown. In the progression of the purge line 61 a purge valve 62 is provided.

In order to remove the residue from the system, i.e. to empty the line section 10, in connection with a product change, a feed unit 40 for gas is provided. This feed unit 40 comprises a feed line 41 which is connected to the common line element 63. The feed line 41 is in connection with a pressure gas device (not shown), so that via the feed line 41 on the distributor 21, thus on the third line region 15 and on the upper apex region 19, pressure gas can be introduced into the line section 10. In order to control the pressure gas supply a valve 42 is provided in the feed line 41.

The device of FIGS. 1 and 2 further comprises a residue removal line 50 which branches off from the line section 10 at a branch-off 51 and runs back again into the line section 10 at a run-in 52. The branch-off 51 is thereby arranged on the side of the line shut-off valve 20 facing the tank on the line section 10, namely on the lower apex region 18 on the pump 9. The run-in 52 is provided on the side of the line shut-off valve 20 facing away from the tank on the line section 10, namely on the transition between the third line region 15 and the fourth line region 16 in the region of the wetting sensor 22. In the region of the branch-off 51, a further wetting sensor 54 is provided on the residue removal line 50. In addition a residue removal shut-off valve 53 is provided on the residue removal line 50. This valve is generally in direct proximity to the measurement section, thus in the region of the run-in 52, and is drawn here further down merely for the sake of clarity. A pump 99 can also be optionally provided in the residue removal line 50.

A compensating line 90 with a valve 91 is provided between the first line region 13, which extends between the tank 1 and the lower apex region 18 with the pump 9 and which decreases in height from the tank-side end region 11 towards the apex region 18, and the second line region 14, which extends between the lower apex region 18 and the feed unit 40 for gas and which increases in height from the apex region 18 towards the feed unit 40. Said compensating line 90 forms a bypass of the lower apex region 18 for the purpose of residue removal without foam formation above the lower apex region 18. By means of the compensating line 90, gas which flows in at the feed unit 40 during residue removal can be conveyed into the first line region 13 thereby bypassing the lower apex region 18. Also in the first line region 13, the gas can thus act from above upon the liquid to be displaced so that bubbling through in the liquid is avoided and the risk of foam formation is reduced. According to the invention the valve 91 is thus closed during the main discharge and merely opened during the residue removal, in particular during the first residue removal phase. In order to facilitate reliable residue removal "from above", the compensating line 90 appropriately runs into the line section 10 in the region of the collecting line 3 and/or the tank valve 2.

Instead from the second line region 14 the compensating line 90 can also branch off from the third line section 15.

A further wetting sensor 66 is provided on the distributor 21, thus on the third line region 15 of the line section 10. In addition, a temperature sensor 65 for detecting the temperature of the liquid flowing in the line section 10 is provided on the distributor 21. This temperature sensor 65, which is shown merely in FIG. 2, is used for compensating the amount. It can additionally be used to draw conclusions concerning the viscosity of the product and thus to increase the measurement precision. In this connection, viscosity curves can be used which are stored for known products.

A first pressure sensor 67 is arranged between the tank-side end region 11 and the flow measuring unit 7, preferably between the sieve 23 and the flow measuring unit 7, in particular between the fill degree measuring unit 6 and the flow straightener 24. A further pressure sensor 68 can be provided between the flow measuring unit 7 and the discharge-side end region 12. The pressure sensor 67, possibly in connection with the further pressure sensor 68, can also be used, if the conveying power of the pump 9 and possibly the currently measured flow speed of the product are known, to determine the viscosity, and by derivation from this the measurement value for the discharged volume can be corrected accordingly. In addition a pressure sensor 67' for measuring the pressure prevailing in the line section 10 is provided on the distributor 21.

At the discharge-side end region 12 of the line section 10, in particular on an end plate of the line section 10, a further purge unit 70 is provided. This comprises a purge line 71 which is in line connection on the one hand with the line section 10 and on the other hand with a container 73 and on which purge line 71 a valve 72 is arranged.

The device further comprises a preferably two-axis inclinometer 4 which can be connected in particular in a fixed manner to the horizontal part of a tanker vehicle and which can be used to control the purge unit 70.

A respective compressed-air-impacted purge line 36, 36' is arranged on the hose connections 32, 32', in which purge lines 36, 36' a valve 37 or 37' is arranged in each case.

The device according to the invention can have an electronic control and computer unit which receives measurement signals of the individual sensors and measuring units and according to the measurement and function sequence controls the individual valves and preferably also the pump.

The device shown can be operated as follows:

1. Filling

If the line section 10 is empty at the start of the discharge, it must be filled with the desired product. In this connection the tank valve 2 of the desired product tank 1, which is formed as a bottom valve, is opened. The line shut-off valve 20 and the purge valve 62 are also opened, whereas the discharge valves 31, 31' are closed. Liquid flows through the opened valve 2 from the tank 1 into the line section 10. This can take place solely by means of gravity or also using the pump 9, which can be operated at a slow speed for initial filling. The inflowing liquid displaces gas out of the line region 10. On account of the inclined position of the second line region 14 and the fourth line region 16, this gas moves on account of its buoyancy to the intermediately lying third line region 15, from which it is removed via the purge line 61 with the open purge valve 62. The air can thereby be removed into the tank, as shown in the drawing, but in principle also into another tank, container or into the ambient air.

In this way the whole line section 10 with all line regions 13 to 17 is filled.

Should the device arranged on a tanker for example be inclined during filling, a situation can arise in which regions of the discharge-side end region 12 of the line section 10 lie above the transition between the fourth line region 16 and the fifth line region 17. In particular in this case, "air pockets" can form in the discharge-side end region 12 under certain conditions, which remain by reason of their buoyancy in the discharge-side end region 12 and cannot flow away to the upper apex region 18 with the purge unit 60. These "air pockets" can be discharged by means of the purge unit 70 into the container 73, possibly together with liquid residue. It can be provided in this connection that the valve 72 of the purge unit 70 can be switched in dependence upon the measurement values of the inclinometer 4, i.e. the valve 72 can be opened if a relevant inclined position of the system is present. If the wetting sensor 27 detects liquid in the discharge-side end region 12, the valve 72 of the purge unit 70 can be closed again.

As soon as the wetting sensor 66 on the distributor 21 responds, there is complete filling and the purge valve 62 can be closed.

2. Product Discharge (Main Discharge)

For product discharge, the desired discharge valve 31 or 31' is opened, so that the desired hose connection 32 or 32', respectively, can be supplied. In the embodiment shown the hose connection 32 leads to a wet hose and the hose connection 32' to a dry hose. Two or more wet hoses with associated discharge valves can also be provided.

The desired tank valve 2 is also opened for discharge and the pump 9 is in operation. This pump 9 conveys liquid from the tank 1 via the line section 10 to the desired hose connection 32 or 32'. The conveyed liquid thereby flows through the fill degree measuring unit 6 and the flow-through measuring unit 7. On the basis of the measurement values of these two measuring units 6 and 7, the volume conveyed can be determined, whereby the measurement values can be compensated in relation to gas portions by means of the fill degree measuring unit 6.

3. End of Discharge and Residue Removal for Change of Product

If, after the discharge, a product change is planned, it can be proceeded as follows: If a desired predetermined amount is reached, the pump 9 is stopped. The line section 10 is then subjected to residue removal. In this connection the tank valve 2 is closed. In addition the line shut-off valve 20 in the upper apex region 19 is closed for the first residue removal phase. The residue removal shut-off valve 53 and the valve 42 of the feed unit 40 for gas are opened. Likewise, the shut-off valve 91 is opened. Via the valve 42 and the feed line 41 of the feed unit 40 for gas, compressed air reaches the region of the line section 10 situated in FIG. 1 to the left of the line shut-off valve 20 and via the line 90 with the now open valve 91 also into the collecting line 3. The compressed air displaces the product via the residue removal line 50 into the measurement section with the fill degree measuring unit 6 and the flow measuring unit 7. The amount of this displaced product is measured.

As soon as no more liquid is detected on the wetting sensor 54 of the residue removal line 50 (reaction time for example 2s) and/or on the wetting sensor 22 in the upper apex region 19, thus an air impact is present, the residue removal shut-off valve 53 is closed for the second residue removal phase. At the same time or following this, the line shut-off valve 20 is opened and in the following, second residue removal phase the remainder of the line section (in FIG. 1 to the right of the line shut-off valve 20) is emptied through pressure. Alternatively, the line shut-off valve 20 can remain closed and the residue removal shut-off valve 20 can remain open for the second residue removal phase. The region of the line section 10 situated behind the line shut-off valve 20 in the flow direction is then emptied through pressure via the residue removal line 50.

With effect from the switchover point in time of the line shut-off valve 20, thus from the beginning of the second residue removal phase, the measurement pulses of the flow unit 7 formed for example as a turbine wheel measurement transducer are no longer registered by the electronic control unit. In order to take into consideration the volume flowing off in the second residue removal phase, a residual volume, which has previously been empirically determined through volumetric measurement, is added to the volume measured thus far.

The second residue removal phase is maintained until the wetting sensor 27 no longer detects liquid in the discharge-side end region 12. The open discharge valve 31 or 31' is then closed, likewise the compressed air supply through closure of the valve 42. The whole line system including the line section 10 and collecting line 3 is now virtually free of product. A possibly present overpressure in the line section 10 can be removed via the purge units 60 and/or 70 by opening the valve 62 or 72. The system can now be filled with another product.

4. Optional Wet Hose Emptying

In general, it is common for different wet hoses to be used for different products, so that the wet hoses generally do not have to be emptied for the product change.

If, however, the wet hose provided for example on the hose connection 32 is also to be emptied, this occurs when the valve 31 is closed in that the valve 37 is opened and the hose connection 32 with the wet hose is impacted with compressed air via the purge line 36. The amount discharged from the wet hose can be pumped into an intermediate tank or into the original tank 1. Alternatively, the amount can be discharged. Insofar as the amount is discharged into the customer tank, the known amount in the hose is added to the delivery amount, whereby air pockets which have previously been detected by the fill degree measuring unit 6 can be traced and taken into consideration by calculation on the basis of the established flow speed.

The dry hose arranged on the hose connection 32' can likewise be emptied through compressed air impacting via the purge line 36' or through gravity.

Figure 3:
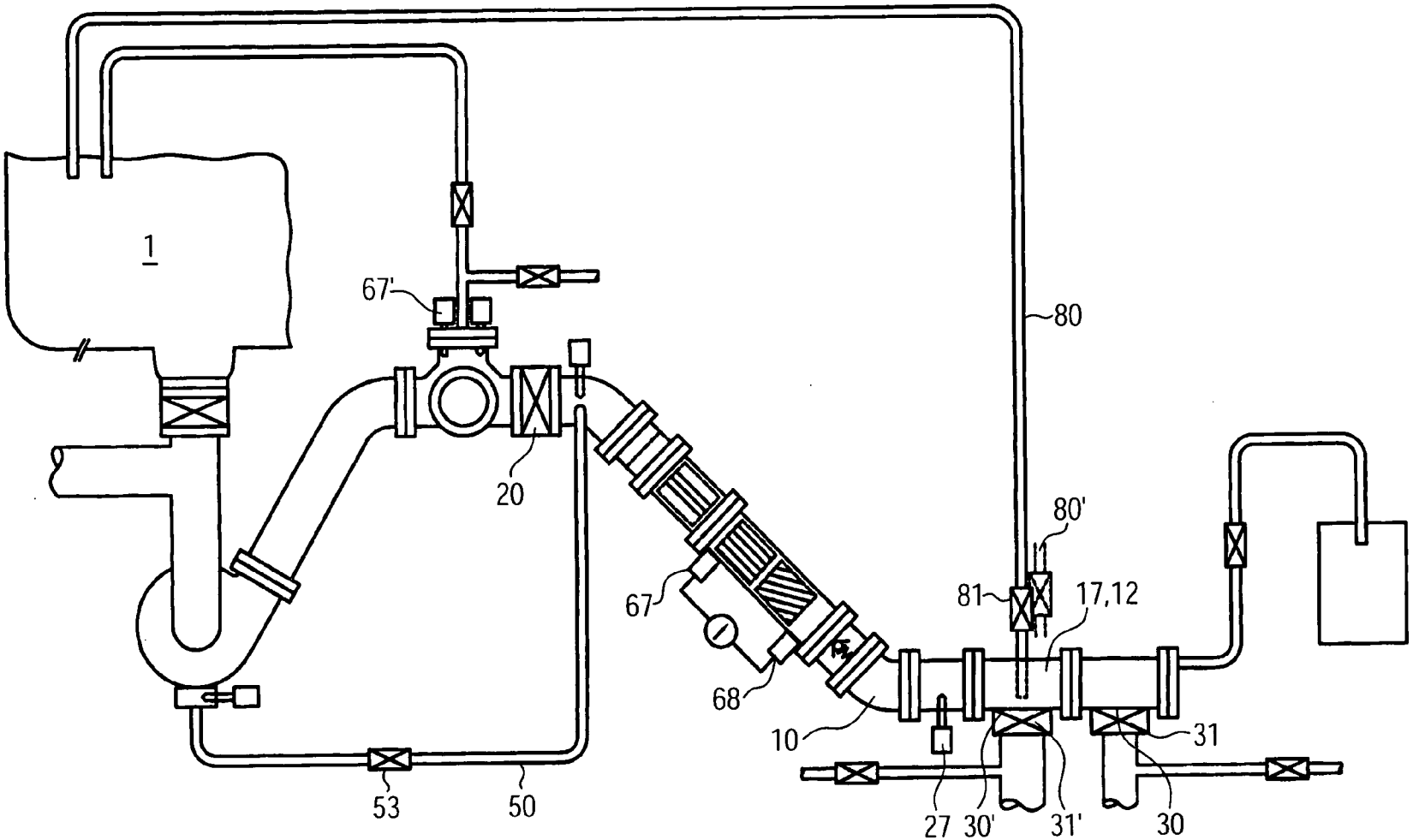
FIG. 3 shows a further embodiment of a device according to the invention.

A further embodiment of a device according to the invention for implementing the method according to the invention is shown in FIG. 3. The embodiment shown in FIG. 3 differs from the embodiment of FIG. 1 merely in that according to FIG. 3 an additional return line 80 is provided. The elements contained in both embodiments are not therefore discussed again in detail at this point.

The return line 80 branches off in the discharge-side end region 12 in the fifth line region 17 of the line section 10 from the line section 10 and leads into the tank 1. A valve 81 is preferably arranged in the region of the line section 10 on the return line 80. Insofar as a plurality of tanks 1 are provided, a plurality of return lines 80' can accordingly also be provided.

The return line 80 allows the product displaced during the residue removal to be conveyed back into the original tank 1 instead of discharging it via the discharge openings 30, 30'.

In order to return the residue removal volume to the tank 1, the procedure is analogue as for the previously described discharge of the residue removal volume. In particular, in the first residue removal phase, with closed line shut-off valve 20 and open residue removal shut-off valve 53, the line region to the left of the line shut-off valve 20 is emptied through pressure. Unlike the embodiment described in association with FIG. 1, however, the discharge valves 31 and 31' hereby remain closed. Instead, the valve 81 is opened and the displaced product passes via the open valve 81 and the line 80 into the original tank 1. After this, the line shut-off valve 20 is opened for the second residue removal phase and the rest of the liquid is pressed out or alternatively the line shut-off valve 20 is kept closed and the residue removal shut-off valve 53 is kept open, so that the region of the line section 10 situated in the flow direction behind the line shut-off valve 20 is emptied through pressure via the residue removal line 50. If the wetting sensor 27 reacts, pressure gas is fed for a further short time in order to also blow the line 80 empty. The complete emptying of the line section 10 can be monitored for example through the pressure sensors 67, 67' and/or 68 and in particular be established as a pressure drop.

In the same way as the system of FIG. 1, the system of FIG. 3 can also be used to discharge the liquid displaced during the residue removal rather than conveying it back into the tank 1. The valve 81 is hereby closed for the residue removal and instead the desired discharge valve 31 or 31' is opened.

Instead of a return of the displaced liquid into the original tank 1, discharge into an intermediate tank can also be provided, whereby, in this embodiment which is not shown, the return line 80 can lead into the intermediate tank.

The invention claimed is:

1. Device for discharging liquid from a tank, comprising a line section, which is formed on a tank-side end region for a fluid connection with the tank and which comprises at least one discharge opening on a discharge-side end region lying opposite the tank-side end region, a feed unit for gas, which is provided on the line section and via which gas can be introduced into the line section, a line shut-off valve for shutting off the line section and which is provided between the tank-side end region and the discharge-side end region on the line section, and a residue removal line, which branches off at a branch-off from the line section and runs at a run-in back into the line section, whereby the branch-off is arranged on the line section between the tank-side end region and the line shut-off valve, and whereby the run-in is arranged on the line section between the line shut-off valve and the discharge-side end region, wherein the feed unit for gas is formed for feeding pressure gas into the line section.

2. Device according to claim 1, wherein the feed unit for gas is arranged so that the gas is introduced into the line section by means of the feed device at the highest point of the line section, and a switchable compensating line leads to the highest point of the tank-side end region.

3. Device according to claim 1, wherein the feed device for gas lies prior to the line shut-off valve in the flow direction.

4. Device according to claim 1, wherein the feed device for gas is arranged in the tank-side end region, or the feed device for gas is arranged between the branch-off of the residue removal line and the line shut-off valve on the line section.

5. Device according to claim 1, wherein a residue removal shut-off valve is provided on the residue removal line, in particular in the region of the run-in of the residue removal line.

6. Device according to claim 1, wherein the feed device for gas is arranged in the region of the line shut-off valve on the line section and/or the run-in of the residue removal line is arranged in the region of the line shut-off valve on the line section.

7. Device according to claim 1, wherein the line section comprises an upper apex region, the line shut-off valve, preferably the feed unit for gas and the run-in of the residue removal line are arranged in the upper apex region of the line section, and a purge unit for purging the line section is arranged in the upper apex region of the line section.

8. Device according to claim 1, wherein the branch-off of the residue removal line is arranged in a lower apex region of the line section, in particular on a pump.

9. Device according to claim 1, wherein in order to determine the amount of liquid discharged, a flow measuring unit and a fill degree measuring unit are arranged between the run-in of the residue removal line and the discharge opening on the line section.

10. Device according to claim 1, wherein a purge unit for purging the line section is arranged on the line section on a side of the line shut-off valve facing away from the tank-side end region, in particular in the discharge-side end region, and/or an inclinometer is provided for determining an angular position of the line section.

11. Tank arrangement comprising at least one tank and a device for discharging liquid from a tank according to claim 1, wherein the line section of the device for discharging liquid is in a fluid connection with the tank on its tank-side end region, particularly via a tank valve.

12. Method for emptying the residue from a line section, which is formed on a tank-side end region for a fluid connection with a tank, which comprises at least one discharge opening on a discharge-side end region lying opposite the tank-side end region, and which comprises a line shut-off valve for shutting off the line section and which is provided between the tank-side end region and the discharge-side end region on the line section, in particular by means of a device according to claim 1, wherein between the tank-side end region and the line shut-off valve pressure gas is introduced into the line section which displaces liquid from the line section, whereby during a first residue removal phase when the line shut-off valve is closed, liquid which is present in the line section between the tank-side end region and the line shut-off valve is displaced by means of the pressure gas, and during a subsequent, second residue removal phase, in particular when the line shut-off valve is open, liquid which is present in the line section between the line shut-off valve and the discharge-side end region is displaced by means of the pressure gas.

13. Method according to claim 12, wherein during the first residue removal phase liquid which is present in the line section between the tank-side end region and the line shut-off valve is displaced at least partially in the direction of the tank-side end region, and during the subsequent, second residue removal phase liquid which is present in the line section between the line shut-off valve and the discharge-side end region is displaced in the direction of the discharge-side end region.

14. Method according to claim 12, wherein a residue removal line is provided which branches off at a branch-off from the line section and runs at a run-in back into the line section, whereby the branch-off is arranged between the tank-side end region and the line shut-off valve on the line section, and whereby the run-in is arranged between the line shut-off valve and the discharge-side end region on the line section, whereby a residue removal shut-off valve is arranged on the residue removal line and is opened in the first residue removal phase and preferably closed in the second residue removal phase, and during the first residue removal phase liquid which is present in the line section between the tank-side end region and the line shut-off valve is removed from the line section via the residue removal line and conveyed back again into the line section between the line shut-off valve and the discharge-side end region.

15. Method according to claim 12, wherein a fill level is detected in the line section between the line shut-off valve and the discharge-side end region and/or in the residue removal line, and the first residue removal phase is ended when the detected fill level reaches a predetermined value.

16. Method according to claim 12, wherein a measurement of the amount discharged is carried out in the line section between the line shut-off valve and the discharge-side end region, in particular between the run-in of the residue removal line and the discharge-side end region, whereby the measurement of the amount discharged is stopped at the start of or in the course of the second residue removal phase and a previously determined value is added to the measured discharge amount.

17. Method according to claim 12, wherein following the second residue removal phase, an overpressure in the line section is removed by means of at least one purge unit, whereby a purge unit is arranged in particular in an upper apex region of the line section and/or in the discharge-side end region.

18. Method according to claim 12, wherein liquid which is displaced from the line section in the first and/or in the second residue removal phase is conveyed back into the tank or discharged via the discharge opening.

* * * * *